US006267739B1

(12) United States Patent
Cengarle

(10) Patent No.: US 6,267,739 B1
(45) Date of Patent: Jul. 31, 2001

(54) PNEUMATICALLY OPERATED MASSAGING CUSHION

(76) Inventor: Franco Cengarle, Via Di Romagna, 7, 34134, Trieste (IT)

( * ) Notice: Subject to any disclaimer, the term of this patent is extended or adjusted under 35 U.S.C. 154(b) by 0 days.

(21) Appl. No.: 08/983,142

(22) PCT Filed: Jul. 22, 1996

(86) PCT No.: PCT/EP96/03271

§ 371 Date: Apr. 14, 1998

§ 102(e) Date: Apr. 14, 1998

(87) PCT Pub. No.: WO97/04732

PCT Pub. Date: Feb. 13, 1997

(30) Foreign Application Priority Data

Jul. 25, 1995 (IT) ..... VE95A0028

(51) Int. Cl.[7] ..... A61H 9/00; A47C 27/10

(52) U.S. Cl. ..... 601/149; 601/150; 5/710; 5/713

(58) Field of Search ..... 601/148–152; 5/710, 711, 713

(56) References Cited

U.S. PATENT DOCUMENTS 3,613,671 10/1971 Poor .
4,583,255 4/1986 Mogaki et al. .
5,211,162 5/1993 Gillen et al. .

FOREIGN PATENT DOCUMENTS 107197 4/1983 (GB) .
149655 6/1985 (GB) .

*Primary Examiner*—Danton D DeMille
(74) *Attorney, Agent, or Firm*—Hoffman, Wasson & Gitler

(57) ABSTRACT

A pneumatically operated massaging cushion characterised by comprising: a compressor (16), a cyclic distributor (14) fed by said compressor (16) and provided with a plurality of exits (13), at least one manifold (6) comprising a plurality of longitudinal ducts (8) connected to the different exits (13) of said cyclic distributor (14), a plurality of side by side transverse compartments (2) inflatable independently of each other, means (10) for the individual connection of each of said transverse compartments (2) to one of said longitudinal ducts (8), the connections between the longitudinal ducts (8) of said manifold (6) and the exits (13) of said cyclic distributor (14) and between said transverse compartments (2) and said longitudinal ducts of said manifold (6) being such as to ensure the operation and the temporary and successive inflation of the adjacent transverse compartments.

5 Claims, 1 Drawing Sheet

FIG. 1
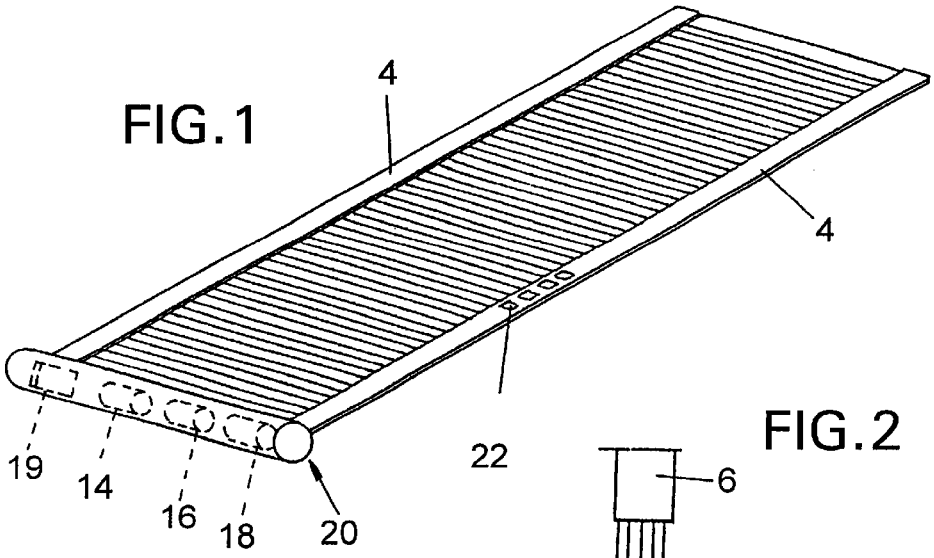
FIG. 2
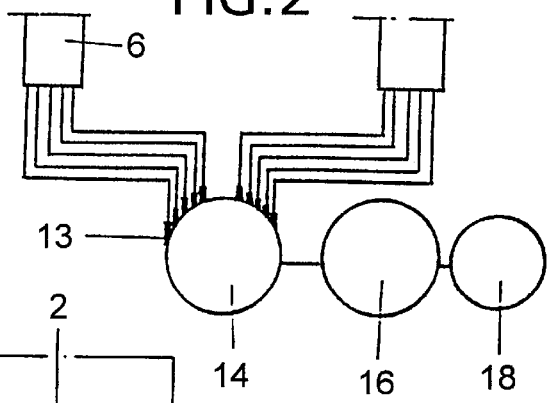
FIG. 3
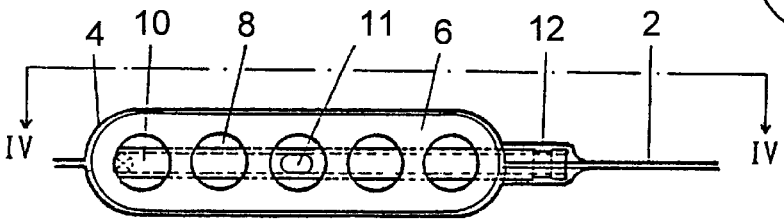
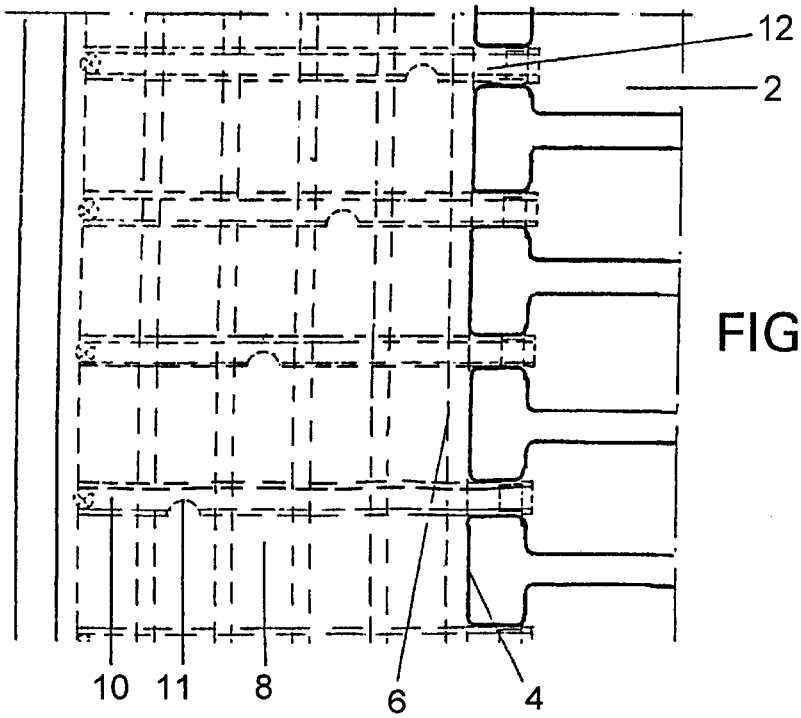
FIG. 4

PNEUMATICALLY OPERATED MASSAGING CUSHION

FIELD OF THE INVENTION

This invention relates to a pneumatically operated massaging cushion.

BACKGROUND OF THE INVENTION

Devices are known which massage the body using pressure rollers made to slide along the body, or continuous or intermittent water jets. These known devices are able to perform a massaging function, which is however very localized and on the one hand can cause suffering to particularly sensitive individuals while on the other hand being quite different from manual massage.

Pneumatic devices are also known for relieving decubitus problems.

However they use alternately inflated and deflated compartments which like the preceding achieve a static result much different from that obtainable with manual massage.

Moreover, known devices can in every case be used only on structures specifically constructed for the purpose and cannot be used to convert a support structure for a person in the seated or extended state into a massaging device.

SUMMARY OF THE INVENTION

An object of the invention is to provide a cushion able to perform a massaging effect similar to manual massage on a person seated or extended on it.

A further object of the invention is to provide a massaging cushion which can be applied to a bed, to an armchair, and generally to any structure on which a person can extend or seat or simply rest himself with his entire body or with only part of it.

BRIEF DESCRIPTION OF THE DRAWINGS

These and further objects are attained according to the invention through a pneumatically operated massaging cushion as described in claim 1.

A preferred embodiment of the present invention is further described hereinafter with reference to the accompanying drawings, in which:

FIG. 1 is a perspective view of the massaging cushion of the invention;

FIG. 2 is a schematic view of its pneumatic circuit;

FIG. 3 is an enlarged vertical section through the region in which a duct of manifold is connected to an inflatable compartment; and FIG. 4 is a plan view in the direction IV—IV of FIG. 3.

DETAILED DESCRIPTION OF THE INVENTION

As can be seen from the figures, the cushion of the invention comprises a plurality of transverse inflatable compartments 2, of width between 2 and 4 cm, preferably 3 cm, arranged parallel side by side to cover a rectangular surface of dimensions suitable for receiving an extended person (for example 50×180 cm).

For particular requirements (cushions for children, cushions for local massage) the covered surface can naturally be of different shape and/or dimensions. The transverse compartments 2 are preferably formed by superimposing two sheets of air-impermeable flexible material and joining them together along parallel bonding lines.

The transverse compartments 2 are bounded laterally by two longitudinal compartments 4 extending along the entire length of the cushion and each housing a rubber extruded member 6 containing five parallel ducts 8.

Each inflatable compartment 2 is connected to one of the five ducts 8 of one of the rubber extruded member 6 by a rigid tube 10, which is inserted by one end into a transverse compartment 2, passes through all the ducts 8 of one of the two rubber extruded member 6, is closed at the end distant from the compartment 2 and comrpises a hole 11 which connects its interior to one of the ducts 8 provided in the extruded member 6.

Specifically, the first transverse comparment 2 is connected to the first duct 8 of the first extruded member 6, the second transverse compartment is connected to the second duct 8 and so on to the fifth transverse compartment 2 which is connected to the fifth duct 8 of the first extruded member 6. The sixth transverse compartment 2 is then connected to the first duct of the second extruded member 6, the seventh transverse compartment 2 is connected to the second duct 8 of the second extruded member 6 and so on to the tenth transverse compartment 2, which is connected to the fifth duct 8 of the second extrusion 6. The preceding succession is then repeated, ie the eleventh transverse compartment 2, like the first, is connected to the first duct 8 of the first extruded member 6, and so on. The elastic nature of the extrusions 6 ensures that the tubes 10 are secured in a sealed manner, a layer of adhesive 12 provides a seal between the tube 10 and that transverse compartment 2 into which it is inserted.

The five ducts 8 of one longitudinal extruded member 6 and the five ducts 8 of the other longitudinal extrusion 6 are connected to the ten exits 13 of a rotary distributor 14 having an air inlet 15 fed by a compressor 16 operated by a preferably direct current electric motor 18. Each exit 13 can be controlled by a solenoid valve 17.

The rotary distributor 14, the compressor 16, the electric motor 18 and an electronic control card 19 for programming the sequence, direction and general manner in which the massage is carried out are housed in a cylindrical transverse compartment 20 provided at one end of the cushion.

From the compartment 20 there emerge an electric feed cable and a further cable which passes through one of the two longitudinal compartments 4 to be connected to a pushbutton unit 22 provided with operating pushbuttons located in a position comfortably accessible to a person extended on the cushion. The cushion of the invention operates as follows:

on operating the "on" pushbutton the electric motor 18 is powered and drives the compressor 16 and the rotary distributor 14, which cyclically connects the delivery side of the compressor 16 to one of the longitudinal ducts 8 of the two rubber extruded members 6.

By virtue of the connection between the longitudinal ducts 8 and the transverse compartments 2 of the cushion, the compressed air generated by the compressor 16 is transmitted cyclically to the successive transverse compartments 2, causing their temporary inflation and giving rise to a sort of wave which travels from one end of the cushion to the other. Moreover, as the number of transverse compartments 2 is generally greater than the number of longitudinal ducts 8, this wave is multiplied and has a pitch equal to the distance between simultaneously inflated compartments 2 (in the described embodiment the pitch is ten compartments 2).

Because of the width of each transverse compartment 2, which when in the inflated state has similar dimensions to a finger, this wave travelling from one end to the other of the cushion produces a massaging effect on a person extended on the cushion which is similar to manual massage.

The aforedescribed cushion can be placed on any surface on which a person can extend himself, sit or simply rest, and produces a relaxing and calming effect typical of manual massage. In addition:

it can be used without negative effect by new born babies, in a cot, as a replacement for the movement of a perambulator, and can in general be used by persons of any age, it is of benefit to invalids who have to lie on a wheelchair for the entire day, it can be used for dynamic massage against decubitus problems, it can be used in all occasions for relaxation, by beauticians, and after sports, it can involve the entire body or just particular regions, such as the neck or the sole of the feet, if operated by a direct current motor it can be powered by battery and is hence portable and/or usable on board vehicles, it occupies a very small space when not working, it can also be used by a person extended in the prostrate state, the sequence, the direction and the general manner in which the massage is carried out can be programmed.

What is claimed is:

1. A pneumatically operated massaging cushion comprising a compressor driven by an electric motor;

a cyclic distributor fed by said compressor and provided with a plurality of exits;

a plurality of side-by-side transverse compartments inflatable independently of each other;

at least one rubber extruded section comprising a plurality of longitudinal ducts, an end of each duct being individually connected to one of said plurality of exits of said cyclic distributor, said rubber extrusion section being housed in a longitudinal compartment provided in the cushion at one end of the side-by-side transverse compartments;

tubes for individually connecting each of said transverse compartments to one of said longitudinal ducts, said tubes passing through all the longitudinal ducts of the rubber extruded section and having one end opening into said transverse compartment, its other end closed, and an aperture which individually connects its interior with one of said longitudinal ducts according to a prefixed sequence of inflation, the connections between the longitudinal ducts of said rubber extruded section and the exists of said cyclic distributor and between said transverse compartments and said longitudinal ducts of said rubber extruded section being such as to ensure, during operation, a temporary and successive inflation of the side-by-side transverse compartments;

the cyclic distributor, the compressor, the motor being housed in a cylindrical transverse compartment provided at one end of the cushion;

an electronic unit controlling the mutual operation of the parts of the cushion.

2. A cushion as claimed in claim 1, wherein the cyclic distributor comprises an air inlet conduit and a plurality of outlet conduits, each provided with a solenoid valve controlled, independently of the others, by said electronic unit which provides for progressive inflation of said transverse compartments.

3. A cushion as claimed in claim 1, wherein the cyclic distributor is of rotary type.

4. A cushion as claimed in claim 1, wherein the transverse compartments are formed from two sheets of air-impermeable flexible material bonded together along the lines of separation between adjacent compartments and at the ends of these latter.

5. A cushion as claimed in claim 1, wherein the transverse compartments have a width of between 2 and 4 cm.

* * * * *